United States Patent [19]

Limburg et al.

[11] 4,423,131

[45] Dec. 27, 1983

[54] PHOTORESPONSIVE DEVICES CONTAINING POLYVINYLSILICATE COATINGS

[75] Inventors: William W. Limburg, Penfield; John M. Pochan, Ontario, both of N.Y.; Charles L. Beatty, Gainesville, Fla.

[73] Assignee: Xerox Corporation, Stamford, Conn.

[21] Appl. No.: 373,909

[22] Filed: May 3, 1982

[51] Int. Cl.[3] ..... G03G 5/14

[52] U.S. Cl. ..... 430/59; 430/67; 430/961; 430/523

[58] Field of Search ..... 430/66, 67, 961, 523, 430/271, 59; 526/279; 162/168.1, 164.4, 181.6, 181.7

[56] References Cited

U.S. PATENT DOCUMENTS

| | | | |
|---|---|---|---|
| 2,879,360 | 3/1959 | Floyd, Jr. | 201/63 |
| 2,886,434 | 5/1959 | Owens | 96/1 |
| 3,140,174 | 7/1964 | Clark | 430/132 |
| 3,397,982 | 8/1968 | Lane | 96/1.5 |
| 3,629,000 | 12/1971 | Back et al. | 430/67 |
| 3,650,737 | 3/1972 | Maissel et al. | 96/1 PC |
| 3,997,343 | 12/1976 | Weigl et al. | 430/67 |
| 4,011,080 | 3/1977 | McCabe | 430/62 |

*Primary Examiner*—John D. Walsh
*Attorney, Agent, or Firm*—E. O. Palazzo

[57] ABSTRACT

This invention is directed to an improved photoresponsive device containing as a protectant overcoating a top layer of a crosslinked polyvinylsilicate resulting from the reaction of polysilicic acid with a polyvinyl alcohol having a number average molecular weight of from about 10,000 to about 100,000.

15 Claims, No Drawings

PHOTORESPONSIVE DEVICES CONTAINING POLYVINYLSILICATE COATINGS

BACKGROUND OF THE INVENTION

This invention is generally directed to an elctrostatographic imaging device containing a polyvinylsilicate overcoating; and more specifically, the present invention is directed to polyvinylsilicate coatings and photoconductive devices, especially layered photoconductive devices containing such coatings. The polyvinyl silicate coatings, and photoconductive devices containing these coatings are resistant to ozone, and to other reactive chemical substances produced by corona charging devices; and further such coatings are substantially insoluble in most solvents, thus allowing them to be formed as a discrete layer, which layer does not affect the intrinsic properties of the photoreceptor device being protected. Further, the polyvinyl silicate coatings of the present invention can be fabricated as thin films in view of their extremely high wear resistance. Also such coatings function as a release material, allowing the excellent release and transfer of toner images from photoconductive devices. Additionally, in certain liquid ink xerographic development processes the polyvinylsilicate coatings remain essentially nonreactive to the ink/solvent formulation utilized for development.

It is known that the application of protective coatings to certain photoconductive materials, particularly inorganic photoconductive materials, is designed primarily for the purpose of extending the useful life of such devices. Generally in order for these coatings to provide the desired protection they must be applied in a substantially uniform thickness. Additionally, the coating material should be selected so as to not adversely effect the photoelectric properties of the photoreceptor, for example, the coating should not appreciably inject charges in the dark. The protective coastings should also not conduct laterally on the overcoat surface. Further, in some applications the coating must be transparent, and possess a dark resistivity at least equal to the dark resistivity of the photoconductive material. For example, photoconductive materials such as selenium have a resistivity in the dark of $10^{10}$–$10^{12}$ ohm-cm, thus the dark resistivity of the protective coating should be within this range when such a coating is used as a protectant for selenium.

One of the most widely used photoconductive materials is purified vitrious selenium, however, it suffers from two serious defects, namely, its spectral response is somewhat toward the blue or near ultraviolet, and the preparation of uniform films of vitreous selenium has required highly complex processes wherein critical parameters are involved. Accordingly, from a commerical economic aspect, it is important that xerographic selenium devices be utilized for numerous imaging cycles, as is presently practiced in the art.

Deterioration by the mechanical abrasion attendant to the developing and the cleaning processes, wherein in one cleaning process a rapidly rotating brush contacts the photoconductive surface for the purpose of removing therefrom any residual developer particles adhering thereto subsequent to the transfer step, has been observed in selenium. In addition to mechanical abrasion, the selenium photoreceptor may be subjected to intense heat, which over a period of time adversely affects its photoconductivity. In view of this, and for other reasons, various protective coatings, or overcoatings have been applied to selenium devices. Thus, there is described in U.S. Pat. No. 3,397,982 an electrostatographic device comprising a photoconductive layer including an inorganic glass material, the photoconductive layer containing an overcoating comprised of various oxides, such as germanium oxides, the oxides of vanadium, and silicon dioxide.

Additionally, in U.S. Pat. No. 2,886,434 there is disclosed processes for the protecting of selenium photoconductive substances with a thin transparent film of a material having electrical characteristics equal to selenium. Examples of materials disclosed as a protective layer for selenium include zinc sulfide, silica, various silicates, alkaline earth fluorides, and the like.

Furthermore, there is disclosed in U.S. Pat. No. 2,879,360 a photoconductive cell comprising a support substrate, a layer of photoconductive material, and as a protectant, a thin film of silicon dioxide superimposed upon the photoconductive layer.

Recently, there has been developed for use in xerographic imaging systems overcoated organic imaging members, including layered organic and layered inorganic photoresponsive devices. In one such photoresponsive device, there is employed a conductive substrate, overcoated with a hole injecting layer, which in turn is overcoated with a hole transport layer, followed by an overcoating of a carrier generating layer, and an insulating organic resin overcoating as a top coating. These devices have been found to be very useful in various imaging systems, and have the advantage that high quality images are obtained with the overcoating acting primarily as a protectant. The details of this type of overcoated photoreceptor are fully disclosed in U.S. Pat. No. 4,251,612 on a dielectric overcoated photoresponsive imaging member and imaging method.

Another similar overcoated photoresponsive device is comprised of a conductive substrate layer, a generating layer, and a transport layer. In such devices the generating layer can be overcoated on the transport layer, or the transport layer may be overcoated on the generating layer. Examples of such devices are described in U.S. Pat. No. 4,265,990, the disclosure of which is totally incorporated herein by reference.

Several of the above-described overcoated organic photoresponsive devices are not protected after extended usage, and in some instances the imaging properties of these devices are adversely effected after a few imaging cycles. More specifically, with such devices the properties of the top overcoating material, or the properties of the other layers are adversely effected by ozone, and other contaminants contained in the environment; by the developing compositions which contact the photoresponsive device for the purpose of rendering the image visible, and mechanical abrasion during cycling. Accordingly, images of low quality, or no images whatsoever are produced depending upon the extensiveness of the damage caused to the layers of the photoconductive device. Furthermore, in some instances, the toner materials employed do not sufficiently release from the photoresponsive surface, leaving unwanted toner particles thereon, causing such particles to be subsequently embedded into, or transferred from the imaging surface in later imaging steps, thereby resulting in undesirable images of low quality, and/or high background. Also, in some instances, the dried toner particles adhere to the imaging member and print out as background areas due to the adhesive attraction of the toner particles to the photoreceptor surface. This can be particularly troublesome when known silicone resins or elastomeric polymers are employed as overcoat materials for their melted toner release characteristics, since any low molecular weight components contained in these polymers can migrate to the surface of the silicone polymer layer, and act as an adhesive toward dry toner particles brought in contact therewith during image development. There thus results undesirable high background areas in the final image since toner particles together with the toner images are effectively transferred to the receiving sheet.

Accordingly, there continues to be a need for protective overcoatings for use in photoconductive devices, including layered devices, in which the overcoatings are chemically resistant, are substantially insoluble in most solvents, have excellent toner release properties, and can be fabricated as a thin film as a result of their extremely high wear resistance. Further, there continues to be a need for protective coatings which are of extreme hardness (superhard) or essentially equivalent to a hardness of glass, which coatings provide photoreceptor surfaces that are scratch and wear resistant. Furthermore, there continues to be a need for protective overcoatings which are (1) flexible and transparent, (2) non-reactive with, and impermeable to chemical materials produced by corona charging devices, and (3) can be easily cleaned.

SUMMARY OF THE INVENTION

It is a feature of the present invention to provide improved photoconductive devices, including layered devices, which overcomes the above noted disadvantages.

A further feature of the present invention is the provision of certain polyvinylsilicate materials as overcoatings for photoconductive devices, which overcoatings are chemically resistant, substantially insoluble in most solvents, extremely wear resistant, and can be fabricated as thin films.

An additional feature of the present invention is the provision of certain polyvinylsilicates which are applied as coatings to photoconductive devices, such as layered devices, which coatings prevent sticking of toner particles to the photoresponsive layers.

An additional feature of the present invention is the provision of polyvinylsilicate overcoatings which are scratch and wear resistant, while simultaneously being transparent.

In a further feature of the present invention there is provided certain polyvinylsilicate overcoatings which are non-reactive with, and impermeable to corona produced chemical substances, and which are also easily cleaned.

These and other features of the present invention are accomplished by the provision of superhard polyvinylsilicate coatings having a cross-linked molecular structure, and photoresponsive devices, especially layered photoresponsive devices containing such coatings. More specifically, in one embodiment, the present invention is directed to photoresponsive devices comprised of amorphous selenium, amorphous selenium alloys, halogen doped selenium substances or halogen doped selenium alloys; or devices comprised of a substrate, a photogenerating layer and a transport layer; and as an overcoating layer in each instance, a polyvinylsilicate material produced from polyvinylalcohol, or its copolymers of a number average molecular weight of from about 10,000 to about 100,000, and polysilicic acid. The molecular weight of the polyvinyl alcohol reactant can be less than 10,000 or greater than 100,000 providing the objectives of the present invention are achieved.

The polyvinylsilicate polymers illustrated herein are believed to contain a cross-linked molecular structure formed by the condensation of silanol (Si—OH) functional groups with other silanol functional groups, or silanol groups, and carbonol (C—OH) groups, with the loss of one mole of water per crosslink. These condensation coupling reactions can be illustrated by reference to the following general equations:

Equation A

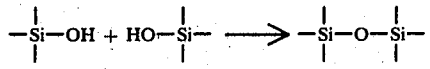

silanol-silanol coupling

Equation B

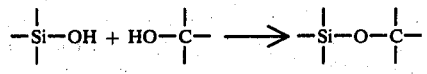

silanol-carbonol coupling

Illustrative examples of polyvinylsilicate polymers embraced within the scope of the present invention and useful as coatings for the photoresponsive devices described include those represented by the following general product formulas:

I.

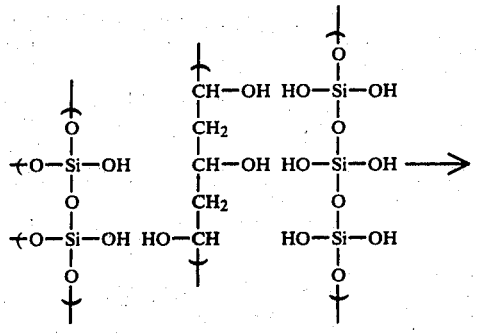

Polysilicic Acid — Polyvinyl Alcohol — Polysilicic Acid

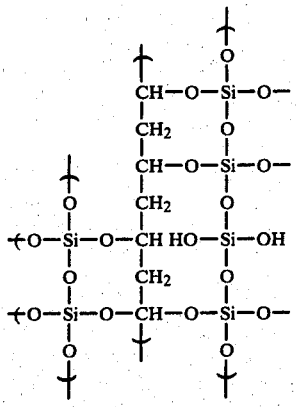

Polyvinylsilicate

-continued

II.

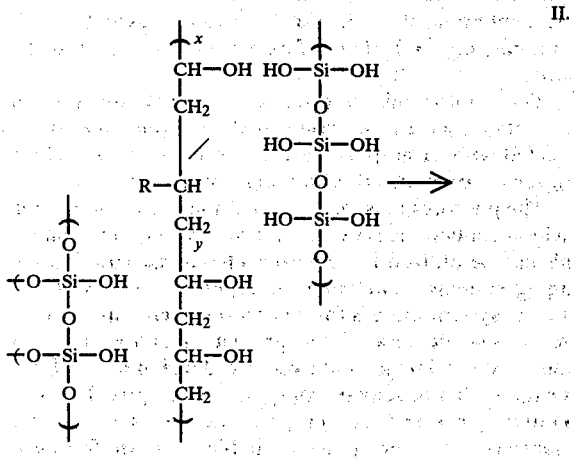

Polysilicic Acid | A Copolymer of Vinyl Alcohol | Polysilicic Acid

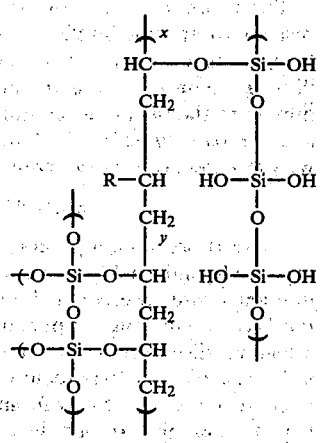

Polyvinylsilicate wherein R represents groups such as aromatic, preferably phenyl, carbazole, alkyl alkoxy, preferably butyl alkoxy, ethoxy, halogen, and the like and X and Y are percentage numbers totalling one hundred, thus the value of X can range from about 1 percent to about 99 percent, while the value of Y can vary from about 1 percent to about 99 percent. In this representation the vinylalcohol containing copolymer results from the hydrolysis product of copolymers of vinylacetate with other comonomers, vinylcarbazole, butyl vinylether, ethyl vinylether, diethylfumarate, vinyl chloride, vinylidene chloride and the like. It is believed that such copolymers modify the physical and chemical properties of the resultant polyvinylsilicate product. Modification of the polyvinylsilicate can also be accomplished by changing the ratio of comonomers in the vinylalcohol copolymers. Generally, the greater the amount of vinylalcohol units in the polyvinylalcohol copolymer, the greater will be the crosslinked density in the polyvinylsilicate product. It is believed that increases in crosslink density are associated with increased hardness of the resulting material, whereas decreased crosslink density is generally associated with increased flexibility. Furthermore, the polysilicic acid component can be altered by the hydrolysis of trialkoxysilanes or the cohydrolysis of trialkyoxysilanes and tetraalkoxysilane.

Additionally, the polyvinylsilicate materials of the present invention can be modified and caused to harden further by adding thereto various other suitable materials noted for this purpose including silica, alumina, and the like.

The polyvinylsilicate materials of the present invention are applied to the photoresponsive device in a thickness of from about 0.1 micron to about 2 microns, however the thickness is determined by a number of factors, including, for example, the electrical design parameters established for the entire photoresponsive device. Thus, the polyvinylsilicate material can be applied in thicker or thinner coatings providing the objectives of the present invention are achieved; accordingly, thicknesses ranging from about 0.5 microns to about 5 microns are also suitable.

the polyvinylsilicate materials of the present invention can be applied as the overcoating layer to a number of photoresponsive devices, including inorganic photoconductive materials disclosed herein, and organic photoconductive systems, such as layered organic photoresponsive devices including those comprised of a substrate, a photogenerating layer, and a transport layer, as well as other overcoated photoresponsive devices containing a hole injecting layer. One three-layered device embraced within the scope of the present invention is comprised of a substrate, overcoated with a generating layer containing vanadyl phthalocyanine or trigonal selenium, which in turn is overcoated with a transport layer containing certain diamines as defined hereinafter. Such a photoresponsive devices are described in Xerox U.S. Pat. No. 4,265,990, the disclosure of which is totally incorporated herein by reference. This device is then overcoated with the polyvinylsilicate polymers of the present invention.

Examples of materials useful in the layered photoconductive devices described, which devices can be treated with the polyvinylsilicate polymers of the present invention, include the following illustrative layers.

The substrate can be opaque or substantially transparent and may comprise non-conducting materials such as inorganic or organic polymeric materials; a layer of an organic or inorganic material having a conducive surface layer arranged thereon, such as aluminized Mylar, or a conductive material such as aluminum, brass or the like. The substrate is generally flexible, however, it may also be rigid and can assume many different configurations such as a plate, a cylindrical drum, an endless belt and the like. The thickness of the substrate layer can be over 100 mils, but is preferably from about 3 to 10 mils.

The charge carrier transport layer can be any number of numerous suitable materials which are capable of transporting holes, this layer generally having a thickness in the range of from about 5 to about 50 microns and preferably from about 20 to about 40 microns. This transport layer comprises molecules of the formula:

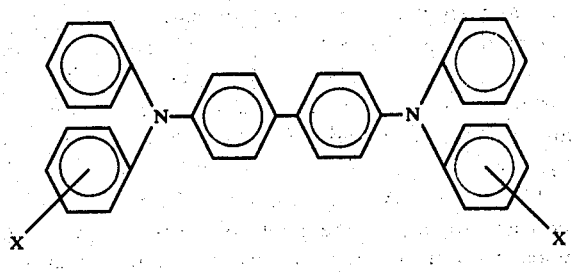

dispersed in a highly insulating and transparent organic resinous material wherein X is selected from the group consisting of (ortho) $CH_3$, (meta) $CH_3$, (para) $CH_3$, (ortho) Cl, (meta) Cl, (para) Cl. The charge transport layer is substantially non-absorbing in the spectral region of intended use, i.e., visible light, but is "active" in that it allows injection of photogenerated holes from the charge generator layer and electrically induced holes from the injecting interface. The highly insulating resin, which has a resistivity of at least $10^{12}$ ohm-cm to prevent undue dark decay, is a material which is not necessarily capable of supporting the injection of holes from an injecting or generator layer and is not capable of allowing the transport of these holes through the material. However, the resin becomes electrically active when it contains from about 10 to 75 weight percent of the substituted N,N,N',N'-tetraphenyl-[1,1'-biphenyl]-4,4'-diamines corresponding to the foregoing formula. Compounds corresponding to this formula include, for example, N,N'diphenyl-N,N'-bis-(alkylphenyl)-[1,1-biphenyl]-4,4'-diamine wherein the alkyl is selected from the group consisting of methyl such as 2-methyl, 3-methyl and 4-methyl, ethyl, propyl, butyl, hexyl and the like. In the case of halo substitution, the compound is named N,N'-diphenyl-N,N'bis(halo phenyl)-[1,1'-biphenyl]-4,4'-diamine wherein the halo atom is 2-chloro, 2-chloro or 4-chloro.

Other electrically active small molecules which can be dispersed in the electrically inactive resin to form a layer which will transport holes include triphenylamine, bis-(4-diethylamino-2-methylphenyl)phenylmethane; 4', 4"-bis(diethylamino)-2', 2"-dimethyltriphenyl methane; bis-4(-diethylaminophenyl)phenylmethane; and 4,4'bis(diethylamine)-2', 2"-dimethyltriphenylmethane.

The generating layer, includes, for example, numerous photoconductive charge carrier generating materials provided they are electronically compatible with the charge carrier transport layer, that is, they can inject photoexcited charge carriers into the transport layer and charge carriers can travel in both directions across the interface between the two layers. Particular photoconductive charge carrier generating materials include as indicated herein amorphous and trigonal selenium, selenium-arsenic and selenium-tellurium alloys, halogen doped selenium compositions, halogen doped amphorous selenium alloys wherein the dopant is present in the amount of from about 20 parts per million to about 10,000 parts per million, and organic charge carrier generating materials such as phthalocyanines, for example, the X-form of metal free phthalocyanine, or metal phthalocyanines including vanadyl phthalocyanine. These materials can be used alone or as a dispersion in a polymeric binder. This layer is typically from about 0.5 to about 10 microns or more in thickness. Generally, it is desired to provide this layer in a thickness which is sufficient to absorb at least 90 percent (or more) of the incident radiation which is directed upon it in the imagewise exposure step. The maximum thickness is dependent primarily on factors such as mechanical considerations, e.g., whether a flexible photoreceptor is desired.

The photoconductive device useful in the present invention can also be comprised of a substrate, overcoated with a transport layer as described herein, which in turn is overcoated with a generating layer.

The photoresponsive devices of the present invention which contain the polyvinylsilicate overcoating materials can be utilized in numerous electrostatographic imaging systems including xerographic imaging systems. In one system there is formed on the overcoated photoresponsive devices of the present invention, a latent electrostatic image, followed by development of the image with a developer composition comprised of well known toner and carrier particles, and subsequently transferring the image to a suitable substrate followed by permanently affixing the image thereto. Other types of imaging systems are also included within the scope of the present invention, and is not intended to be limited to the specific system described.

The invention will now be described in detail with respect to specific preferred embodiments thereof, it being understood that these examples are intended to be illustrative only and the invention is not intended to be limited to the materials, conditions, process parameters and the like recited herein. Parts and percentages are by weight unless otherwise indicated.

EXAMPLE I

There is prepared a photoresponsive device containing an aluminized Mylar substrate in a thickness of 3 mils and coated thereover, 1.5 microns, a photogenerating layer containing 10 percent by weight of trigonal selenium, dispersed in 90 percent by weight of polyvinyl carbazole as a 10 percent solid solution in a mixture of toluene and tetrahydrofuran, followed by overcoating of a charge transport layer, in a thickness of from about 25 to 30 microns, which layer contains 20 percent by weight solids of a mixture of about 50 to 60 percent by weight of polycarbonate, commercially available as Makrolon, and 40 to 50 percent by weight of N,N'-diphenyl-N,N',-bis(3-methylphenyl),1,1'-biphenyl- 4,4'-dimaine.

A polyvinyl silicate polymer coating is then prepared in the following manner. There is prepared solution I which contains a soluble form of silicic acid by hydrolyzing tetraethoxysilane under acidic conditions by vigorously stirring for one minute in a glass jar 85 grams of tetraethoxysilane, 10 grams of water, and 5 grams of concentrated hydrocholoric acid. Pressure resulting in the jar is relieved, and vigorous shaking is contained for 4 additional minutes. The sealed jar is then placed on a steam bath for about one hour, and the stream flow adjusted to maintain the temperature at 60° C. The reaction mixture is then allowed to cool resulting in a soluble form of silicic acid.

A second solution (II) is then prepared by mixing together 90 grams of cold water and 10 grams of a low molecular weight polyvinylalcohol, commercial available as DuPont 50-05, which is a copolymer containing 87-89 percent of vinyl alcohol, and 11-13 percent of vinyl acetate.

A mixture of 50 percent by weight of the polysilicic acid solution, reference solution I prepared above, and 50 percent by weight of the polyalcohol solution, reference solution II prepared above, is applied to the above prepared photoresponsive device as a top coating on the charge transport layer, using a Meyer rod, resulting in a film of a thickness of about 1 micron of a polyvinylsilicate polymer.

The device is placed in an oven at 80° C. for five minutes and the general appearance of the film changes from a soft sticky wet composition to a clear glass-like hard film which adheres strongly to the stop surface of the photoreceptor device in that such film is not separated from the photoresponsive device by (1) physically pulling the film therefrom, (2) folding, or (3) attempting to scrape off the film utilizing a scraper blade.

EXAMPLE II

The procedure of Example I is repeated with the exception that there is employed as the polyvinylsilicate overcoating a mixture of a solution containing 90 percent by weight of the polysilicic solution of Example I, and 10 percent by weight of the polyvinylalcohol solution, solution II of Example I, and substantially similar results are obtained.

EXAMPLE III

There is prepared a photoresponsive device in accordance with Examples I and II with the exception that the solution mixtures are dried at 40° C. for five minutes, followed by curing in ammonia vapor for one hour to effect cross linking of the polyvinylsilicate, and substantially similar results are obtained.

EXAMPLE IV

There is prepared a photoconductive device containing an aluminum substrate coated to a thickness of 60 microns with a layer comprised of vacuum deposited amorphous selenium. This device is then coated with a polyvinyl silicate polymer coating prepared in the following manner. There is prepared solution I which contains a soluble form of silicic acid by hydrolyzing tetraethoxysilane under acidic conditions by vigorously stirring for one minute in a glass jar 85 grams of tetraethoxysilane, 10 grams of water, and 5 grams of concentrated hydrocholoric acid. Pressure resulting in the jar is relieved, and vigorous shaking is continued for 4 additional minutes. The sealed jar is then placed on a steam bath for about one hour, and the stream flow adjusted to maintain the temperature at 60° C. The reaction mixture is then allowed to cool resulting in a soluble form of silicic acid.

A second solution (II) is then prepared by mixing together 90 grams of cold water and 10 grams of a low molecular weight polyvinylalcohol, commercial available as DuPont 50-05, which is a copolymer containing 87-89 percent of vinyl alcohol, and 11-13 percent of vinyl acetate.

A mixture of 50 percent by weight of the polysilicic acid solution, reference solution I prepared above, and 50 percent by weight of the polyalcohol solution, reference solution II prepared above, is applied to the above prepared photoresponsive device as a top coating on the selenium layer, using a Meyer rod, resulting in a film of a thickness of about 1 micron of a polyvinylsilicate polymer.

The device is placed in an oven at 80° C. for five minutes and the general appearance of the film changes from a soft sticky wet composition to a clear glass-like hard film which adheres strongly to the top surface of the photoreceptor device in that such film is not separated from the photoresponsive device by (1) physically pulling the film therefrom, (2) folding, or (3) attempting to scrape off the film utilizing a scraper blade.

EXAMPLE V

The procedure of Example I is repeated with the exception that there is employed in place of the polyvinylalcohol solution a low molecular weight, about 3,000 weight average molecular weight of a copolymer of vinylacetate, 37-40 percent by weight, and vinyl alcohol 72.9-77 percent by weight, which solution is commercially available as Gelvato® from Monsanto Plastics and Resins Company, Indian Orchard, Mass., and substantially similar results are obtained.

EXAMPLE VI

The procedure of Example II is repeated with the exception that there is added to the coating solution 25 percent by weight of submicron hydrophobic silica particles commercially avilable as CAB-O-SIL, grade PTG-1, from Cabot Corporation, Boston, Mass. The silica is dispersed in the mixture of polysilicic acid solution and polyvinyl alcohol using well known ball milling techniques for the purpose of breaking up aggiomerates of silica.

A very hard transparent abrasion resistant coating results.

EXAMPLE VII

A photoresponsive device is prepared in accordance with Example I with the exception that there is substituted for the polysilicic acid solution a composition prepared from mixing 85 grams of tetraethoxysilane, in a weight percent ratio of 1 percent of triethoxysilane and 99 percent by weight of ethyltriethoxysilane, 10 grams of water, and 5 grams of concentrated hydrochloric acid. The resulting solution is then cured by ammonia treatment. There is formed a clear transparent abrasion resistant polyvinylsilicate coating which is resistant to ozone and acts as a protectant for the photoresponsive device.

The above procedure is repeated with the exception that there is employed a mixture of tetraethoxysilane and ethyltriethoxysilane in a weight percent ratio of 99 percent of tetraethoxysilane, and 1 percent by weight of ethyltriethoxysilane. Substantially similar results are obtained.

The polyvinylsilicate photoconductive devices of Examples I, II, III, IV, V and VI are resistant to ozone, and other contaminants.

Although the invention has now been described with respect to specific preferred embodiments, it is not intended to be limited thereto but rather those skilled in the art will recognize that variations and modifications may be made therein which are within the spirit of the invention and the scope of the claims.

We claim:

1. An improved photoresponsive device consisting essentially of a supporting substrate, a photogenerating layer, a charge transport layer containing diamine molecules of the following formula,

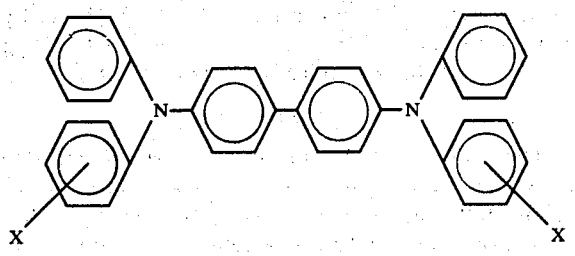

wherein X is ortho ($CH_3$), meta ($CH_3$), para ($CH_3$), ortho (Cl), meta (Cl), or para (Cl), and as a protective overcoating a top layer of a cross-linked polyvinylsilicate resulting from the reaction of polysilicic acid with a polyvinyl alcohol having a number average molecular weight of from about 10,000, to about 100,000.

2. An improved photoresponsive device in accordance with claim 1 wherein the photogenerating layer is situated between the protective overcoating and the charge transport layer.

3. An improved photoresponsive device in accordance with claim 1 wherein the photogenerating layer is situated between the supporting substrate and the charge transport layer.

4. An improved photoresponsive device in accordance with claim 1 wherein the photogenerating layer contains a photogenerating pigment dispersed in an inactive resinous binder, and wherein the charge transport layer is comprised of diamine molecules dispersed in a resinous binder.

5. An improved photoresponsive device in accordance with claim 1 wherein the polyvinyl alcohol is a copolymer containing about 87 to about 89 percent of vinyl alcohol, and from about 11 to about 13 percent of vinyl acetate.

6. An improved photoresponsive device in accordance with claim 1 wherein the polyvinylsilicate coating is present in a thickness of from about 0.1 micron to about 5 microns.

7. An improved photoresponsive device in accordance with claim 1 wherein the photoresponsive device is comprised of amphorous selenium.

8. An improved photoresponsive device in accordance with claim 1 wherein the photoresponsive device is comprised of selenium alloys.

9. An improved photoresponsive device in accordance with claim 8 wherein the selenium alloy contains selenium and arsenic, or selenium and tellurium.

10. An improved photoresponsive device in accordance with claim 1 wherein the photogenerating layer is vanadyl phthaloyanine, or trigonal selenium.

11. An improved photoresponsive device in accordance with claim 1 wherein the charge transport layer is N,N'-diphenyl-N,N'-bis(3-methylphenyl)[1,1'-biphenyl]-4,4'-diamine.

12. An improved photoresponsive device in accordance with claim 1 wherein the polyvinyl silicate polymer contains the following structural unit:

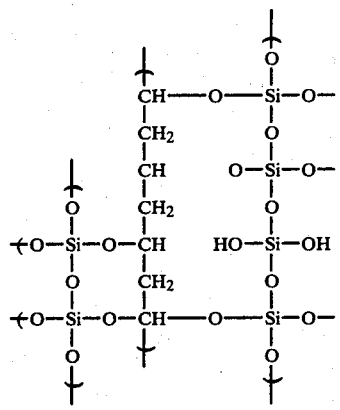

13. An improved photoresponsive device in accordance with claim 1 wherein the polyvinylsilicate polymer contains the following structural unit:

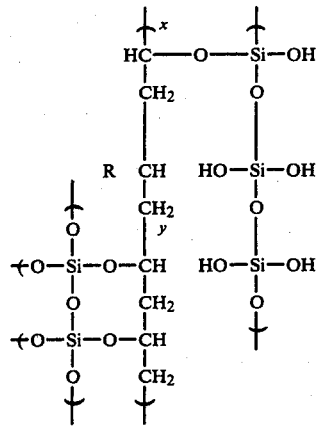

wherein R is an aromatic group, a carbozole, an alkyl alkoxy, or halogen, X and Y are percentage numbers totalling 100.

14. An improved photoresponsive device in accordance with claim 13 wherein R is phenyl, X is 50 and Y is 50.

15. An improved photoresponsive device in accordance with claim 1 wherein the substrate has a thickness of from about 3 mils to about 10 mils, the generating layer has a thickness of from about 0.5 microns to about 10 microns, and the transport layer has a thickness of from about 5 microns to about 50 microns.

* * * * *